US011873698B1

(12) United States Patent
Acosta Villarreal et al.

(10) Patent No.: US 11,873,698 B1
(45) Date of Patent: Jan. 16, 2024

(54) PUMP-OUT PLUG FOR MULTI-STAGE CEMENTER

(71) Applicant: Halliburton Energy Services, Inc., Houston, TX (US)

(72) Inventors: Frank Vinicia Acosta Villarreal, Houston, TX (US); Priyanshkumar Desai, Houston, TX (US); Timothy James Weber, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/957,452

(22) Filed: Sep. 30, 2022

(51) Int. Cl.
*E21B 33/16* (2006.01)

(52) U.S. Cl.
CPC ..... *E21B 33/165* (2020.05)

(58) Field of Classification Search
CPC ..... E21B 33/16; E21B 33/165
See application file for complete search history.

(56) References Cited

U.S. PATENT DOCUMENTS 3,097,699 A 7/1963 Orr
3,358,770 A 12/1967 Zandmer
3,417,822 A * 12/1968 Howell ..... E21B 31/03 175/320
3,789,926 A 2/1974 Henley et al.
3,948,322 A 4/1976 Baker
4,286,662 A 9/1981 Page, Jr.
4,487,263 A 12/1984 Jani
4,674,569 A 6/1987 Revils et al.
4,842,062 A * 6/1989 Schneider ..... E21B 34/14 166/317
5,024,273 A 6/1991 Coone et al.
5,279,370 A 1/1994 Brandell et al.
5,368,098 A * 11/1994 Blizzard, Jr. ..... E21B 33/146 166/387
5,411,095 A 5/1995 Ehlinger et al.
5,443,124 A 8/1995 Wood et al.
5,647,434 A 7/1997 Sullaway et al.
5,765,641 A 6/1998 Shy et al.
6,026,903 A 2/2000 Shy et al.
6,244,342 B1 6/2001 Sullaway et al.
6,425,442 B1 7/2002 Latiolais, Jr. et al.
6,796,377 B2 9/2004 Butterfield, Jr. et al.
6,802,373 B2 10/2004 Dillenbeck et al.
7,237,611 B2 7/2007 Vincent et al.
(Continued)

FOREIGN PATENT DOCUMENTS

EP 1262629 A1 12/2002
WO 2022132183 A1 6/2022

OTHER PUBLICATIONS

Halliburton Catalog titled "Casing Equipment" (2015), entire catalog.

(Continued)

*Primary Examiner* — Shane Bomar
(74) *Attorney, Agent, or Firm* — McAfee & Taft

(57) ABSTRACT

A downhole tool has a tubular body defining an outer wall. A port is defined in the outer wall and a plug is received in the port. The plug is detachably connected to the outer wall and expellable into an annulus between the tubular body and a wellbore in which the downhole tool is placed upon the application of pressure in an interior of the tubular body.

17 Claims, 6 Drawing Sheets

(56) References Cited

U.S. PATENT DOCUMENTS

| | | | | |
|---|---|---|---|---|
| 7,857,052 | B2 | 12/2010 | Giroux et al. | |
| 7,866,402 | B2 | 1/2011 | Williamson, Jr. | |
| 8,215,404 | B2 | 7/2012 | Makowiecki et al. | |
| 8,616,276 | B2 | 12/2013 | Tips et al. | |
| 8,646,537 | B2 | 2/2014 | Tips et al. | |
| 8,720,561 | B2 | 5/2014 | Zhou | |
| 9,010,442 | B2 | 4/2015 | Streich et al. | |
| 9,121,255 | B2 | 9/2015 | Themig et al. | |
| 9,291,007 | B2 | 3/2016 | Darbe et al. | |
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,816,351 | B2 | 11/2017 | Lirette et al. | |
| 9,856,714 | B2 * | 1/2018 | Giroux | E21B 33/146 |
| 9,920,620 | B2 | 3/2018 | Murphree et al. | |
| 10,024,150 | B2 | 7/2018 | Andreychuk et al. | |
| 10,030,472 | B2 * | 7/2018 | Fripp | E21B 43/12 |
| 10,316,619 | B2 | 6/2019 | de Oliveira et al. | |
| 10,358,914 | B2 | 7/2019 | Roberson et al. | |
| 10,557,329 | B2 | 2/2020 | Gao et al. | |
| 10,718,179 | B2 | 7/2020 | Stair et al. | |
| 11,280,157 | B2 | 3/2022 | Acosta et al. | |
| 11,293,253 | B2 | 4/2022 | Santoso et al. | |
| 2006/0207765 | A1 | 9/2006 | Hofman | |
| 2007/0261850 | A1 | 11/2007 | Giroux et al. | |
| 2008/0251253 | A1 | 10/2008 | Lumbye | |
| 2009/0071655 | A1 | 3/2009 | Fay | |
| 2009/0151960 | A1 | 6/2009 | Rogers et al. | |
| 2010/0051276 | A1 | 3/2010 | Rogers et al. | |
| 2010/0163253 | A1 | 7/2010 | Caldwell et al. | |
| 2013/0048290 | A1 | 2/2013 | Howell et al. | |
| 2013/0075094 | A1 | 3/2013 | Rankin | |
| 2013/0233570 | A1 | 9/2013 | Acosta et al. | |
| 2013/0233572 | A1 | 9/2013 | Helms et al. | |
| 2013/0312965 | A1 * | 11/2013 | Themig | E21B 34/14 166/135 |
| 2015/0027706 | A1 | 1/2015 | Symms | |
| 2015/0184489 | A1 | 7/2015 | Resweber | |
| 2016/0208577 | A1 * | 7/2016 | Byberg | E21B 33/128 |
| 2017/0145784 | A1 | 5/2017 | Zhou | |
| 2019/0017366 | A1 | 1/2019 | Alaas et al. | |
| 2019/0249549 | A1 | 8/2019 | Fripp et al. | |
| 2020/0270967 | A1 | 8/2020 | Fong et al. | |
| 2021/0010345 | A1 | 1/2021 | Acosta et al. | |

OTHER PUBLICATIONS

Halliburton Brochure, "Cementing ES II Stage Cementer," Feb. 2009.

Halliburton Brochure, "Fidelis Stage Cementer," Sep. 2013.

International Search Report and Written Opinion dated Apr. 5, 2021, in PCT Application No. PCT/US2020/053694.

International Search Report and Written Opinion dated Jun. 20, 2022, in PCT Application No. PCT/US2022/020696.

"Halliburton Installation and Operating Instructions, OBSIDIO 9-5/8" Multiple Stage Mechanical Packer Collar, pp. 12, 13, 17 and 18, May 2021.

International Search Report and Written Opinion dated Jun. 27, 2023, issued in corresponding PTC Application No. PCT/US2022/052826.

* cited by examiner

PUMP-OUT PLUG FOR MULTI-STAGE CEMENTER

The field relates to a pump-out plug for use in downhole subterranean well operations.

DESCRIPTION OF AN EMBODIMENT

Figure 1:
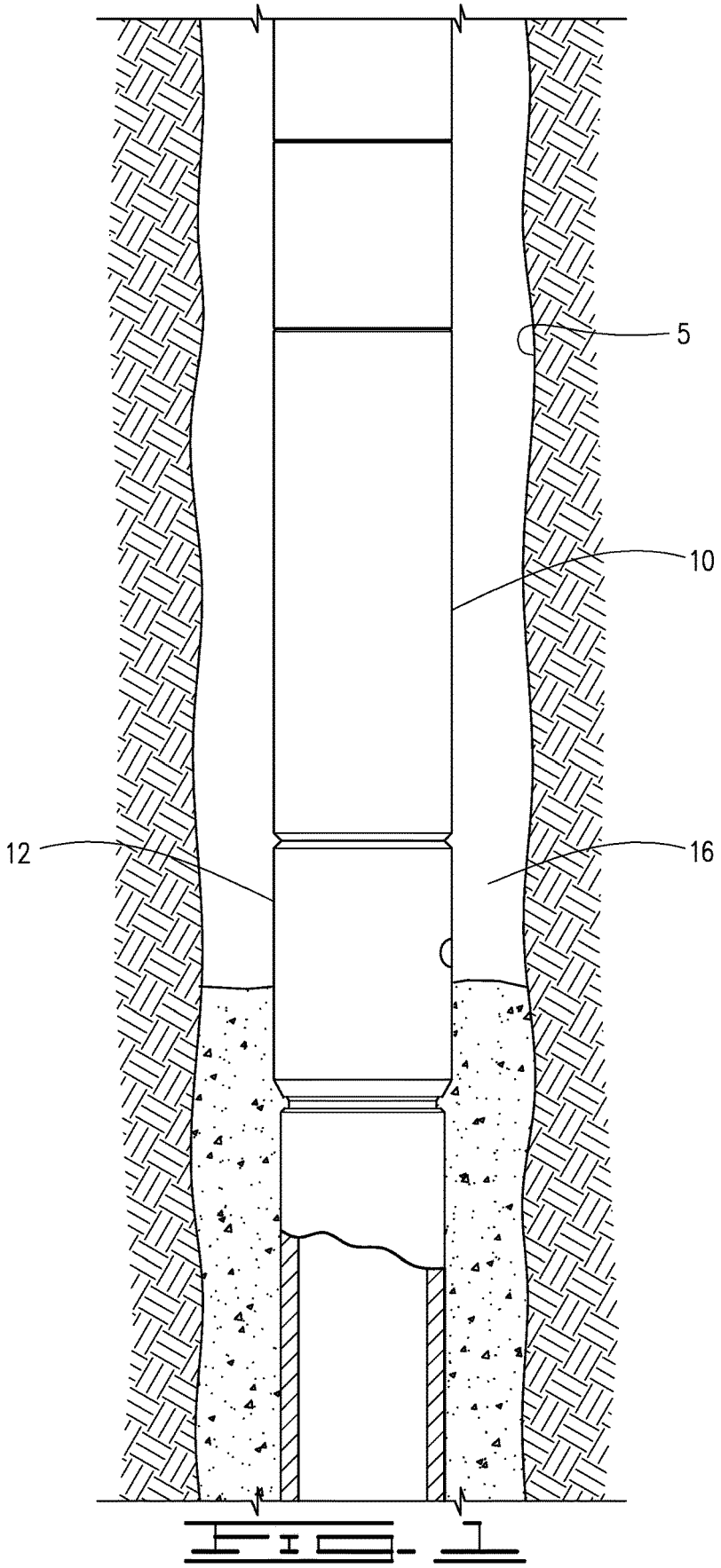
FIG. 1 is a schematic showing a stage cementing tool in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis.

During well completion, it is common to introduce a cement composition into an annulus in a wellbore. For example, in a cased-hole wellbore, a cement composition can be placed into and allowed to set in the annulus between the wellbore wall and the outside of the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing.

As used herein, a "cement composition" is a mixture of at least cement and water. A cement composition can include additives. A cement composition is a heterogeneous fluid including water as the continuous phase of the slurry and the cement (and any other insoluble particles) as the dispersed phase. The continuous phase of a cement composition can include dissolved substances.

A spacer fluid can be introduced into the wellbore after the drilling fluid and before the cement composition. The spacer fluid can be circulated down through a drill string or tubing string and up through the annulus. The spacer fluid functions to remove the drilling fluid from the wellbore.

In cementing operations, a spacer fluid is typically introduced after the drilling fluid into the casing. The spacer fluid pushes the drilling fluid through the casing and up into an annular space towards a wellhead. A cement composition can then be introduced after the spacer fluid into the casing. There can be more than one stage of a cementing operation. Each stage of the cementing operation can include introducing a different cement composition that has different properties, such as density. A lead cement composition can be introduced in the first stage, while a tail cement slurry can be introduced in the second stage. Other cement compositions can be introduced in third, fourth, and so on stages.

A cement composition should remain pumpable during introduction into a wellbore. A cement composition will ultimately set after placement into the wellbore. As used herein, the term "set," with respect to a cement composition and all grammatical variations thereof, are intended to mean the process of becoming hard or solid by curing. As used herein, the "setting time" is the difference in time between when the cement and any other ingredients are added to the water and when the composition has set at a specified temperature. It can take up to 48 hours or longer for a cement composition to set. Some cement compositions can continue to develop compressive strength over the course of several days.

During first stage cementing operations, a first cement composition (e.g., a lead slurry) can be pumped from the wellhead, through the casing and a downhole tool that can include a float shoe or collar, out the bottom of the casing, and into an annulus towards the wellhead. At the conclusion of the first stage, a shut-off plug can be placed into the casing, wherein the plug engages with a restriction near the bottom of the casing such as a seat and closes a fluid flow path through the casing.

Figure 2:
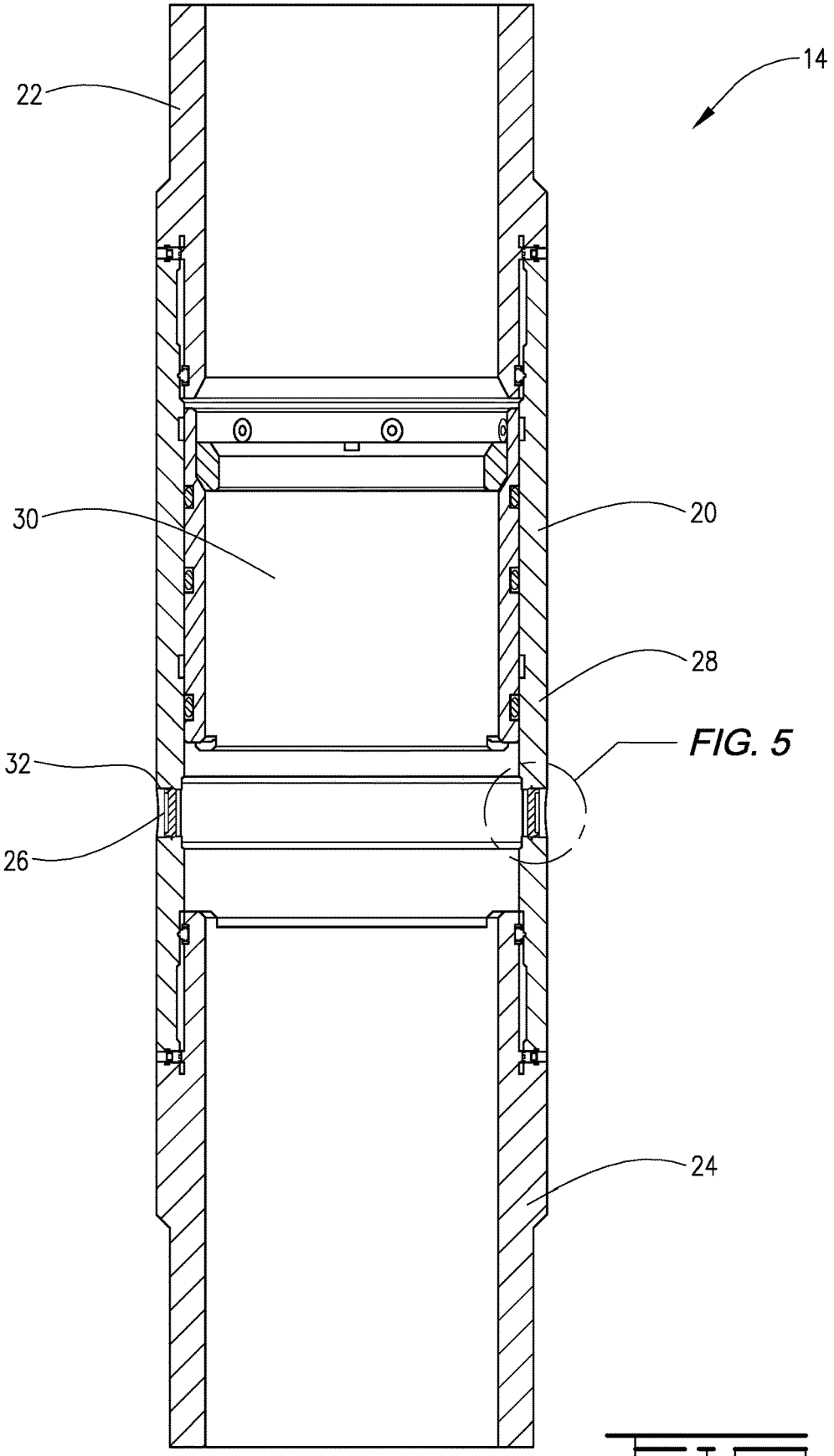
FIG. 2 is a cross section of the cementing tool in a run-in position.
Figure 3:
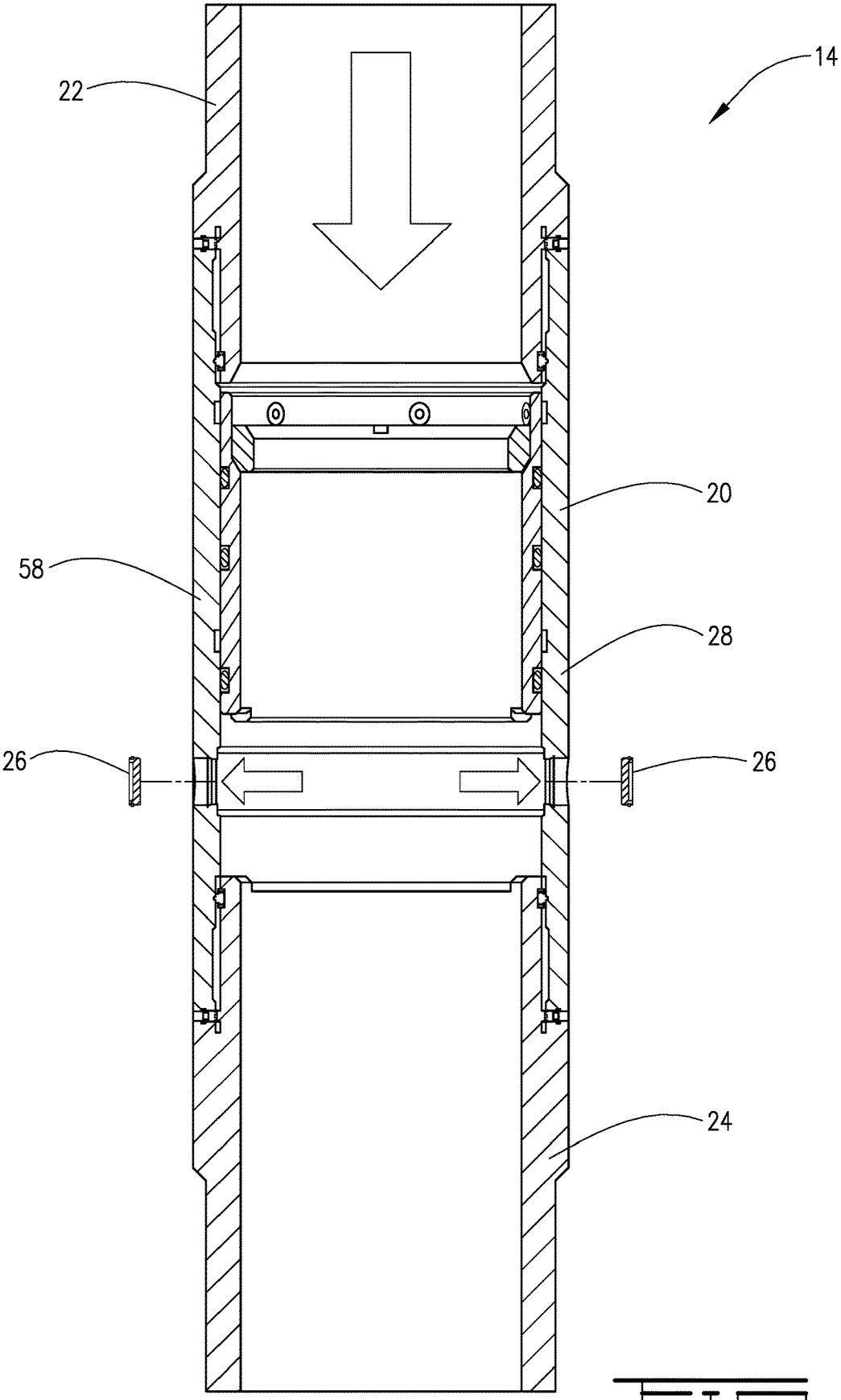
FIG. 3 is a cross section of the tool after a plug has been removed from a port to allow flow therethrough.
Figure 4:
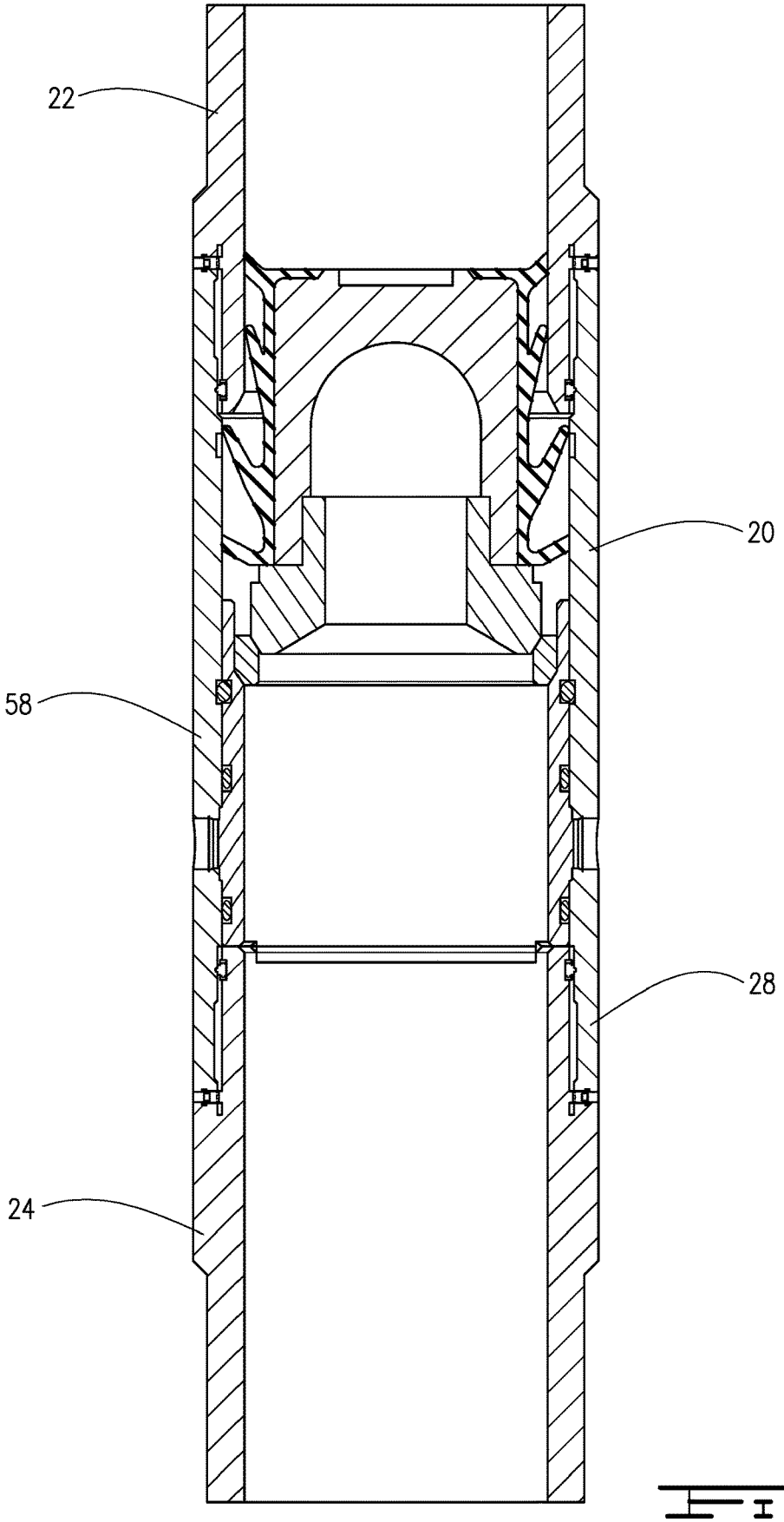
FIG. 4 is a cross section of the tool after cementing has occurred through the tool and a closing sleeve in the tool has moved to a second position.

FIG. 1 shows an apparatus 12, which may be a stage cementing tool 12 lowered into a wellbore 5 on casing 10. As will be described in more detail herein, stage cementing tool 12 is lowered into the wellbore in a run-in position 14 as shown in FIG. 2. Stage cementing tool 12 and wellbore 5 define an annulus 16 therebetween. FIG. 3 shows the tool after a pump-out plug has been removed from a port defined in the stage cementing tool to allow flow therethrough and FIG. 4 shows the stage cementing tool 12 after a closing sleeve has moved to prevent flow through the port after a plug initially positioned in the port is expelled into the annulus 16. In one embodiment stage cementing tool 12 comprises a tubular body 20 and upper and lower connectors 22 and 24 respectively. Upper and lower connectors 22 and 24 may be connected to tubular body 20 by threads or other known means. Upper and lower connectors 22 and 24 are configured to connect in a casing string 10 at the upper and lower ends, respectively, thereof.

A pump-out plug 26 is positioned in a port 32 in an outer wall 28 of stage cementing tool 12, and in the described embodiment is in tubular body 20. Stage cementing tool 12 will have at least one pump-out plug 26, and in the embodiment shown includes a plurality of pump-out plugs 26. As many as four pump-out plugs 26 may be used, although two are normally sufficient to provide redundancy. A central flow passage 30 is defined by stage cementing tool 12. Central flow passage 30 is communicated with annulus 16 through port 32. Port 32 in one embodiment has a first, cylindrical portion 34 that defines an inner diameter 36. A second portion 38 of port 32 tapers inwardly from first portion 34 and defines an inner diameter 40 that is smaller than diameter 36. Plug 26 is sealingly received in port 32. Second portion 38 defines a sloped shoulder 39 against which pump-out plug 26 will abut, to prevent pressure in annulus 16 from pushing plug 26 into central flow passage 30.

Figure 5:
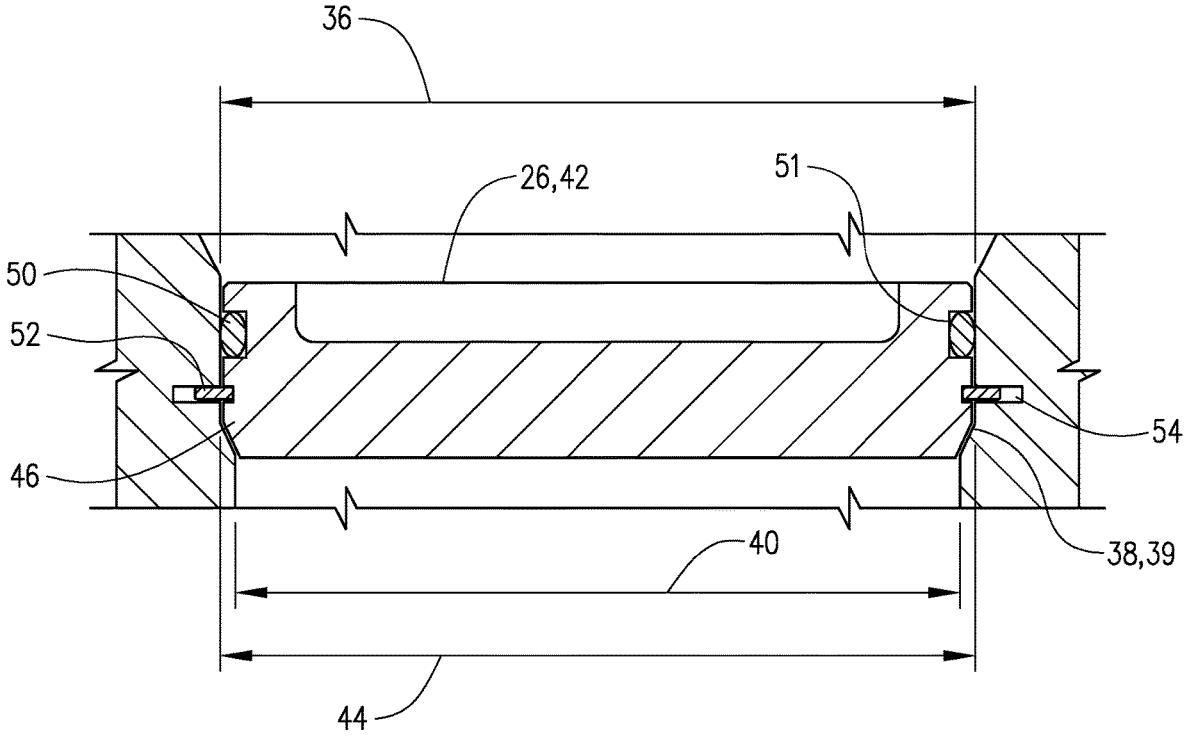
FIG. 5 is a cross section of an embodiment of a port plug in a wall of the tool.

Plug 26 comprises a first generally cylindrical portion 42 received in cylindrical portion 34 of port 32, and a second tapered portion 46 that is tapered inwardly from first portion 42. First portion 42 has an outer diameter 44, and may be referred to as a plug body. Second portion 46 may be referred to as a plug head. Plug head 46 defines a diameter 48, and will engage sloped shoulder 39 as described above. Outer diameter 48 is less than outer diameter 44. A seal 50, which may be an O-ring seal, is received in a groove 51 and sealingly engages port 32. Plug 26 may be retained in port 32 by a frangible retainer, which may be for example a retaining ring, shear pin or other frangible retainer. In the embodiment of FIG. 5, a retaining ring 52 is received in groove 54 in wall 28 and groove 51 in plug 26. Retaining ring 52 detachably connects plug 26 to tubular body 20 and will prevent the plug 26 from being expelled into annulus 16 prematurely. Retaining ring 52 will also aid in preventing the plug 26 from being pushed into central flow passage 30 due to pressure in the annulus 16. The engagement of head 46 with sloped shoulder 39 of port 32 will in any event prevent plug 26 from being pushed into central flow passage 30 as a result of pressure in the annulus 16.

In operation stage cementing tool 12 is lowered into wellbore 5 on casing 10. Tool 12 may be used, for example, in stage cementing operations. In a first stage, or stage prior to the stage to be completed through port 32, a cement composition will be pumped though casing and into annulus 16 through a lower end of casing 10, or through ports below port 32. At the conclusion of the first, or prior stage, a shutoff plug may be pumped into the casing 10. The schematic in FIG. 1 shows cement composition in annulus 16 below stage cementing tool 12. Pressure may be increased to a pressure, which may be a predetermined pressure, that will generate a sufficient force applied to plug 26 to break retaining ring 52. Pump-out plugs 26 will be expelled into annulus 16, and a cement composition or other fluid may be delivered into annulus 16 through port 32. Once the delivery of fluid is complete, a closing sleeve 58 can be moved from the first position shown in FIG. 2 to a second position shown in FIG. 4 in which closing sleeve 58 blocks flow between annulus 16 and central flow passage 30.

Figure 6:
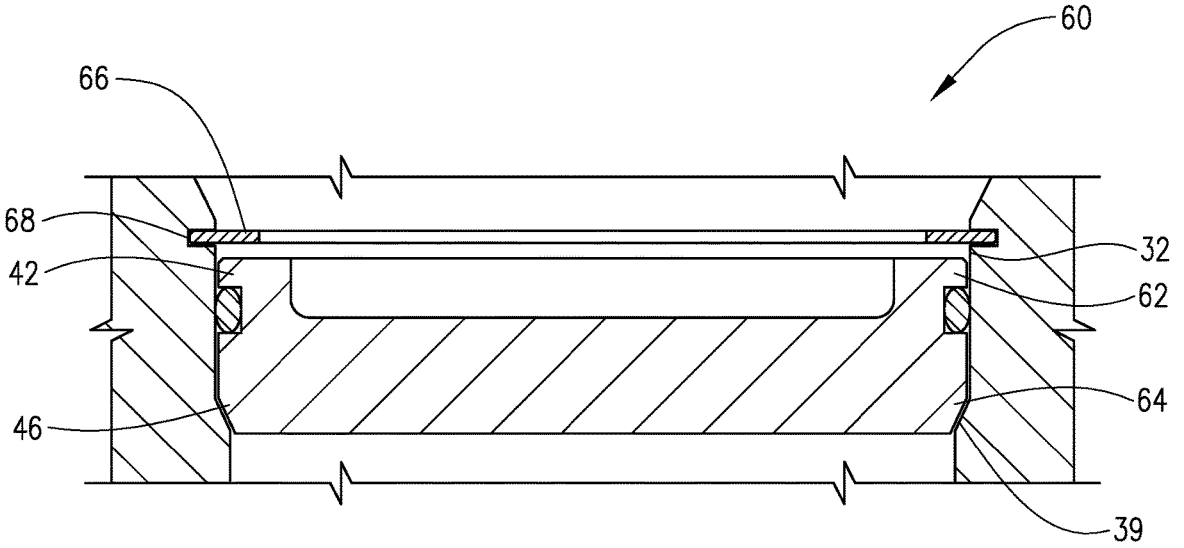
FIG. 6 is a cross section of an additional embodiment of a pump-out plug in a wall of the tool.

An additional embodiment of a pump-out plug is shown in FIG. 6. A pump-out plug 60 is generally identically configured to pump-out plug 26, except that the frangible retainer, in this embodiment a retaining ring, is positioned differently. Pump-out plug 60 has plug body 62 and plug head 64. A retaining ring 66 in a groove 68 in wall 28 is positioned radially outwardly from plug 60. Retaining ring 66 will prevent plug 60 from being expelled into annulus 16 prematurely, and sloped shoulder 39 of port 32 will prevent pump-out plug 60 from being pushed into central flow passage 30. The operation of tool 12 with the pump-out plug 60 is identical to that described with respect to plug 26.

Figure 7:
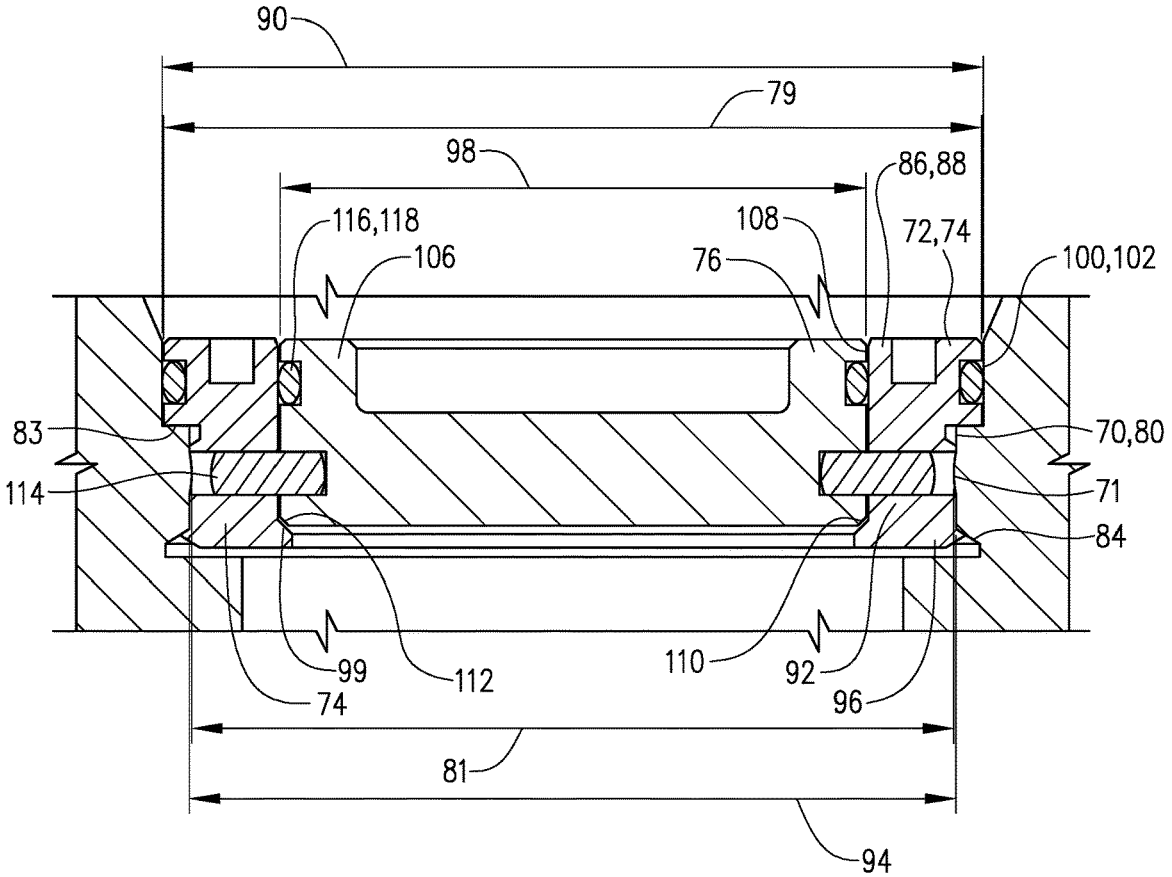
FIG. 7 is a cross section of an additional embodiment of a pump-out plug in a wall of the tool.

A third embodiment of a pump-out plug is shown in FIG. 7. Pump-out plug 76 is part of a pump-out plug assembly 72 positioned in a port 70 in wall 28. Port 70 defines port surface 71. Pump-out plug assembly 72 comprises pump-out plug 76 and mounting sleeve 74. Port 70 is a stepped port with a first portion 78 defining inner diameter 79 and a second portion 80 defining an inner diameter 81. First and second portions 78 and 80 are generally cylindrical, and first diameter 79 is greater than second diameter 81. A shoulder 83 is defined by and between first and second portions 78 and 80, respectively. A groove 84 is defined in port surface 71 at an end of second portion 80.

Mounting sleeve 74 comprises mounting sleeve body 86 that is sealingly received in port 70. Mounting sleeve body 74 has first portion 88 with outer diameter 90 received in first portion 78 of port 70 and second portion 92 with outer diameter 94 received in second portion 80 of port 70. Diameter 94 is smaller than diameter 90. A mounting sleeve head 96 extends outwardly from outer diameter 94 into groove 84 and is captured thereby. Mounting sleeve head 96 extends inwardly from an inner diameter 98 of mounting sleeve 74 and defines a sloped shoulder 99 against which pump-out plug 76 will engage to prevent pump-out plug 76 from being pushed into central flow passage 30. A seal 100 is received in a groove 102 in mounting sleeve 74 and seals against port 70.

Plug 76 is sealingly received in mounting sleeve 74. Plug 76 has first portion 106 having an outer diameter 108 received in mounting sleeve 74. First portion 106 may be referred to as a plug body. Second portion 110 of plug 76 tapers inwardly from plug body 106 and may be referred to as a plug head 110. Plug head 110 tapers inwardly to a diameter 112. A frangible retainer detachably connects pump-out plug 76 to mounting sleeve 74. In the described embodiment, the frangible retainer is a shear pin 114 detachably connecting plug 76 to mounting sleeve 74. Plug 76 is thus detachably connected in wall 28. A seal 116 is received in groove 118 in plug 76 and sealingly engages mounting sleeve 74.

The operation of tool 12 with plug 76 is the same as previously described. Shear pin 114 will prevent premature expulsion into annulus 16, and shear pin 114, along with the engagement of mounting sleeve head 96 with sloped shoulder 99 will prevent plug 76 from being pushed into central flow passage 30. Mounting sleeve head 96 extends over and captures plug 76. Once prior stage cementing is complete, pressure is increased in tool 12 to develop a force sufficient to break shear pin 114 thus expelling plug 72 into annulus 16. Once sufficient fluid has been flowed through port 70 closing sleeve 58 can be moved to cover the port and prevent flow therethrough.

Figure 8:
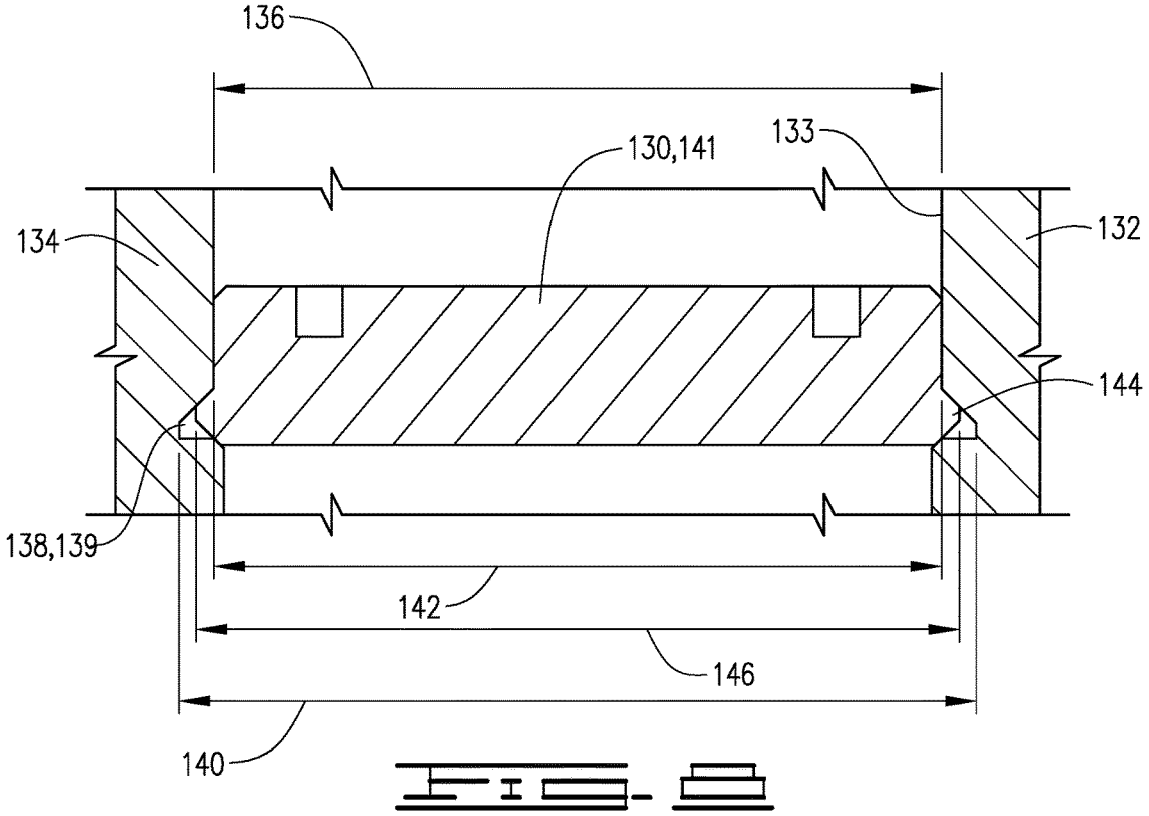
FIG. 8 is a cross section of an additional embodiment of a pump-out plug in a wall of the tool.

An additional embodiment of a pump-out plug is shown in FIG. 8. Pump-out plug 130 is detachably connected to wall 28 in a port 132. Port 132 has port surface 133 and has a first generally cylindrical portion 134 with inner diameter 136 and a second portion 138 extending outwardly therefrom to a diameter 140. Diameter 140 is greater than diameter 136. Second portion 138 defines a groove 139 in a surface 141 of port 132. Pump-out plug 130 has generally cylindrical first portion 143 with outer diameter 142 and second portion 144 that extends therefrom to an outer diameter 146. First portion 134 may be referred to as a plug body and second portion 144 as a plug head. Plug head 144 extends into groove 139 defined in port surface 133 and is captured thereby. Groove 139 prevents premature expulsion of plug 130 into annulus 16 and also prevents plug 130 from being pushed into central flow passage 30. The operation of the tool 12 with plug 130 is as previously described. Once a prior stage of cementing has occurred, pressure will be applied in casing 10 to develop sufficient force to move plug head 144 out of groove 139. Pump-out plug 130 will be expelled into annulus 16 and fluid may be flowed therethrough. Pump-out plug 130 may be made from a material that is sufficiently deformable upon the application of pressure thereto so as to allow plug head 144 to be pushed out of groove 139. Port 132 may be covered by closing sleeve 58 when sufficient cement or other fluid has been delivered therethrough.

Embodiments include:

Embodiment 1. A downhole tool comprising a tubular body defining an outer wall; a port defined in the outer wall; and a plug received in the port, the plug being detachably connected to the outer wall and expellable into an annulus between the tubing and a wellbore in which the downhole tool is placed upon the application of pressure in an interior of the tubular body.

Embodiment 2. The downhole tool of embodiment 1, further comprising a frangible retainer in the outer wall positioned to prevent the plug from being expelled into the annulus until a predetermined pressure is reached.

Embodiment 3. The downhole tool of embodiment 2, the frangible retainer comprising a retaining ring positioned in a groove located between the plug and the annulus.

Embodiment 4. The downhole tool of embodiment 1 further comprising a mounting sleeve sealingly attached to the outer wall in the port; and a shear pin detachably connecting the plug to the mounting sleeve, the plug being sealingly received in the mounting sleeve.

Embodiment 5. The downhole tool of embodiment 4, the mounting sleeve comprising a mounting sleeve head and a mounting sleeve body extending from the mounting sleeve head, the mounting sleeve head being fixed in a groove in the outer wall.

Embodiment 6. The downhole tool of embodiment 5, the mounting sleeve body comprising first and second generally cylindrical body portions having different outer diameters.

Embodiment 7. The downhole tool of any of embodiments 1-6, the plug comprising a plug head and a plug body, the plug head having a greater outer diameter than the plug body and the plug head being removably received in a groove.

Embodiment 8. A downhole tool for use in a wellbore comprising a tubing defining a central flow passage therethrough and having a port defined in a wall thereof communicating the central flow passage with an annulus defined between the tubing and the wellbore; and a plug removably positioned in the port to prevent communication between the central flow passage and the annulus, the plug being expellable into the annulus as a result of a pressure applied in the tubing.

Embodiment 9. The downhole tool of embodiment 8, the plug comprising a composite material.

Embodiment 10. The downhole tool of embodiment 9, the plug comprising a plug body and a plug head, the plug head being removably captured in a groove defined in the port surface to detachably connect the plug in the port.

Embodiment 11. The downhole tool of embodiment 8, the plug being detachably connected to the tubing with a frangible connector.

Embodiment 12. The downhole tool of either of embodiments 8 or 11, the port defining a first generally cylindrical portion and a second portion sloping inwardly toward a center of the port to define a sloped shoulder against which the plug will engage to prevent pressure in the annulus from pushing the plug into the central flow passage.

Embodiment 13. The downhole tool of embodiment 12, the plug comprising a generally cylindrical body and a sloped head extending therefrom, the sloped head engaging the sloped shoulder.

Embodiment 14. The downhole tool of any of embodiments 8-12 further comprising a closing sleeve detachably connected in the tool above the port in a first position in which the sleeve does not block flow through the port, the sleeve movable to a second position covering the port to prevent flow therethrough after the plug is expelled into the annulus.

Embodiment 15. A downhole tool connected in a casing lowered into a wellbore comprising a tubing connected in the casing, the tubing defining a port communicating an annulus between the tubing and the wellbore with a central flow passage of the tubing; and a plug positioned in the port and expellable into the annulus upon the application of a pressure in the tubing, the port configured to prevent pressure in the annulus from pushing the plug into the central flow passage.

Embodiment 16. The downhole tool of embodiment 15, further comprising a frangible connector detachably connecting the plug to the tubing.

Embodiment 17. The downhole tool of embodiment 16, the frangible connector comprising a retaining ring.

Embodiment 18. The downhole tool of embodiment 16 further comprising a mounting sleeve fixed against movement in the port, the plug being detachably connected to the mounting sleeve with the frangible connector.

Embodiment 19. The downhole tool of any of embodiments 15-18, the plug comprising a composite material.

Embodiment 20. The downhole tool of any of embodiments 15-19, further comprising a closing sleeve detachably connected to the tubing in a first position above the port, the closing sleeve movable to a second position preventing communication between the annulus and the central flow passage after the plug is expelled.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps.

It should also be understood that, as used herein, "first," "second," and "third," are assigned arbitrarily and are merely intended to differentiate between two or more cement compositions, flow ports, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A downhole tool comprising:

a tubular body defining an outer wall;

a port defined in the outer wall;

a plug received in the port, the plug being detachably connected to the outer wall and expellable into an annulus between the tubular body and a wellbore in which the downhole tool is placed upon the application of pressure in an interior of the tubular body; and a frangible retaining ring extending radially inwardly in the port beyond an outer diameter of the plug and positioned to prevent the plug from being expelled into the annulus until a predetermined pressure is reached.

2. The downhole tool of claim 1, wherein the frangible retaining ring is positioned in a groove in the outer wall and extends into a groove defined in the plug.

3. The downhole tool of claim 1, the frangible retaining ring positioned in a groove defined in the outer wall located between the plug and the annulus.

4. The downhole tool of claim 1 further comprising:

a mounting sleeve sealingly attached to the outer wall in the port; and a shear pin detachably connecting the plug to the mounting sleeve, the plug being sealingly received in the mounting sleeve, wherein the frangible retaining ring is positioned in a groove in the mounting sleeve and extends into a groove defined in the plug.

5. The downhole tool of claim 4, the mounting sleeve comprising:

a mounting sleeve head; and a mounting sleeve body extending from the mounting sleeve head, the mounting sleeve head being fixed in a groove in the outer wall.

6. The downhole tool of claim 5, the mounting sleeve body comprising first and second generally cylindrical body portions having different outer diameters.

7. A downhole tool for use in a wellbore comprising:

a tubing defining a central flow passage therethrough and having a port defined in a wall thereof communicating the central flow passage with an annulus defined between the tubing and the wellbore; and a plug removably positioned in the port to prevent communication between the central flow passage and the annulus, the plug being expellable into the annulus as a result of a pressure applied in the tubing, the plug comprising a generally cylindrical body and a sloped plug head extending therefrom, the sloped head engaging a sloped shoulder against which the plug will engage to prevent pressure in the annulus from pushing the plug into the central flow passage.

8. The downhole tool of claim 7, the plug comprising a composite material.

9. The downhole tool of claim 8, the sloped plug head being removably captured in a groove defined in a port surface of the port to detachably connect the plug in the port.

10. The downhole tool of claim 7, the plug being detachably connected to the tubing with a frangible connector.

11. The downhole tool of claim 7, the port defining a first generally cylindrical portion and a second portion sloping inwardly toward a center of the port to define the sloped shoulder against which the plug will engage to prevent pressure in the annulus from pushing the plug into the central flow passage.

12. The downhole tool of claim 7 further comprising a closing sleeve detachably connected in the tool above the port in a first position in which the sleeve does not block flow through the port, the sleeve movable to a second position covering the port to prevent flow therethrough after the plug is expelled into the annulus.

13. A downhole tool connected in a casing lowered into a wellbore comprising:

a tubing connected at upper and lower ends in the casing, the tubing defining a port communicating an annulus between the tubing and the wellbore with a central flow passage of the tubing;

a plug positioned in the port and expellable into the annulus upon the application of a pressure in the tubing, the port configured to prevent pressure in the annulus from pushing the plug into the central flow passage, and a frangible connector extending into a groove defined in the plug detachably connecting the plug to the tubing.

14. The downhole tool of claim 13, the frangible connector comprising a retaining ring.

15. The downhole tool of claim 13 further comprising a mounting sleeve fixed against movement in the port, the plug being detachably connected to the mounting sleeve with the frangible connector.

16. The downhole tool of claim 13, the plug comprising a composite material.

17. The downhole tool of claim 13, further comprising a closing sleeve detachably connected to the tubing in a first position above the port, the closing sleeve movable to a second position preventing communication between the annulus and the central flow passage after the plug is expelled.

* * * * *